United States Patent [19]

Ishida

[11] 4,275,335

[45] Jun. 23, 1981

[54] CONSTANT LIGHT INTENSITY ELECTRONIC FLASH DEVICE

[75] Inventor: Tokuji Ishida, Daito, Japan

[73] Assignee: Minolta Camera Kabushiki Kaisha, Osaka, Japan

[21] Appl. No.: 134,297

[22] Filed: Mar. 26, 1980

[30] Foreign Application Priority Data

Mar. 28, 1979 [JP] Japan ..... 54-37270

[51] Int. Cl.[3] ..... H05B 41/32

[52] U.S. Cl. ..... 315/241 P; 315/151; 315/158; 315/207; 315/208; 315/209 R; 315/244

[58] Field of Search ..... 315/151, 156, 158, 159, 315/207, 208, 209 R, 241 P, 244, 311, 340; 354/33, 145

[56] References Cited

U.S. PATENT DOCUMENTS 3,846,811 11/1974 Nakamura et al. ..... 315/158 X 3,946,269 3/1976 Ban ..... 315/241 P X

FOREIGN PATENT DOCUMENTS 4727527 10/1972 Japan .

*Primary Examiner*—Eugene R. LaRoche

*Attorney, Agent, or Firm*—Watson, Cole, Grindle & Watson

[57] ABSTRACT

The emitted light intensity of an electronic flash tube is maintained constant over a given time period by connecting the electronic flash tube in series with an inductor and a switching element across the main capacitor for energizing the flash tube, with a diode being connected across the serially connected flash tube and inductor and a polarity opposite to the current flow from the main capacitor to the flash tube. The switching element is intermittently turned off and on in accordance with the intensity of the light emitted from the flash tube. While the switching element is being turned off, the flash tube is energized by the energy stored in the inductor in the form of a magnetic field. An auxiliary capacitor may be provided across the flash tube. The flash light intensity may be monitored by the measurement of the emitted light, or by the detection of the voltage across the flash tube, or by the detection of the current flowing into the flash tube.

12 Claims, 8 Drawing Figures

CONSTANT LIGHT INTENSITY ELECTRONIC FLASH DEVICE

BACKGROUND OF THE INVENTION

1. Field of the Invention

The present invention relates to an electronic flash device capable of emitting flash light having an intensity that is maintained constant over a predetermined period of time after initiation thereof. Such a flash device may be used to illuminate an object to be photographed in advance of actual exposure to determine a proper exposure condition for the subsequent flash photograph. The flash device may also be used with a focal plane shutter camera, or a slit shutter camera to illuminate the photographic object while the slit travels in front of the film.

2. Description of the Prior Art

The electronic flash device proposed by Japanese Laid-Open Patent No. 47-27527 is basically composed of a Xenon flash tube, a switching element serially connected with the Xenon tube, a main capacitor connected across the serially connected Xenon tube and switching element for storing electric energy for flash firing, and another auxiliary capacitor connected in parallel with the Xenon tube. During the light emission from the Xenon tube, the switching element is periodically and alternately turned on and off by a control means to intermittently supply electric energy from the main capacitor to the Xenon tube. While the switching element is being turned off to interrupt the energy supply, the auxiliary capacitor is discharged through the Xenon tube to energize the latter, so that the intensity of light emitted from the Xenon tube is maintained substantially constant over a predetermined period of time.

In the circuit construction of such an electronic flash device, however, the switching element must be adapted to have a finite non-zero internal resistance, at its turned-on condition to obtain the desired light emission characteristics. This is because the voltage applied across the end terminals of the Xenon tube must be lower than the voltage across the main capacitor in order to fire the Xenon tube at a constant light intensity over a predetermined period of time using the energy stored in the main capacitor. With the above electronic flash device construction, it is necessary for the switching element connected in series with the Xenon tube to include a resistance component so as to provide the Xenon tube with a voltage lower than that of the main capacitor. In such prior art electronic flash device, energy loss inevitably occurs in the switching element that is not contributable to the light emission.

SUMMARY OF THE INVENTION

Accordingly, the primary object of the present invention is to provide an electronic flash device of the aforementioned type but which permits high energy efficiency by reducing or eliminating energy loss.

To attain this object the present invention has basically a construction wherein a series connected Xenon tube, inductor and switching element are connected across the main capacitor for storing energy for flash firing, and a diode is connected across the series connected Xenon tube and inductor. The switching element is alternately turned on and off to intermittently derive electric energy from the main capacitor. The turn-on and turn-off of the switching element is controlled in accordance with the intensity of the light emitted from the Xenon tube, thereby maintaining the emitted light intensity thereof approximately constant.

According to the above construction, the voltage remaining by the subtraction of the voltage across the Xenon tube from the voltage across the main capacitor is applied to the inductor while the switching element is turned on with electric energy being stored in the conductor in the form of the magnetic field. The stored energy is afterwards released and transmitted through the diode to the Xenon tube when the switching element is turned off. In contrast to the prior art device which causes power consumption in the switching element, the present invention provides greatly increased efficiency in the utilization of energy from the main capacitor for the light emission of the Xenon tube. If a capacitor is also connected across the Xenon tube, the electricity charged by the main capacitor to the additional capacitor during the turn-on of the switching element is discharged to the Xenon tube while the switching element is being turned off, thereby allowing the turn-on and off intervals of the switching element to be longer for easy control. It should be noted that although the intensity of emitted light varies in response to the turn-on and off of the switching element, the emitted light can be regarded to have a substantially constant intensity if the cycle of variations in the intensity is made sufficiently fast in comparison with the shutter speed, e.g., as fast as 100 $\mu$sec.

Thus, in accordance with the present invention, extremely high efficiency is attained in the light emission of an electronic flash at constant intensity over a predetermined period of time. Additionally, as the switching element need not cause any energy consumption, a compact, low-priced switching element with small permissible wattage may be employed for the purpose of the present invention.

According to a preferred embodiment of the present invention, the control circuit for controlling the switching element in accordance with the flash light intensity has a hysteresis characteristic wherein the switching element is turned off or made non-conductive when the light intensity reaches or exceeds a given first level. The switching element is turned on or made conductive again when the light intensity decreases to, or below, a given second level which is lower than the first level. Then, the switching element remains conductive until the light intensity reaches or exceeds the higher first level. Thus, the switching element continues its conductive or non-conductive state while the light intensity varies in the range between the first and the second levels. With this structure, the light intensity can change at a longer period than in the case when a single reference level is employed for the switch control.

The monitoring of the flash light intensity may be made not only by directly measuring the flash light but also by detecting the voltage across the flash tube or the electric current flowing through the same. In the latter cases, the monitor circuit may be included within a flash circuit module and does not require an outer element as does the photocell which must be provided outside of such circuit module and which requires additional mechanical structure for the disposition thereof.

DETAILED DESCRIPTION OF THE PREFERRED EMBODIMENTS

Figure 1:
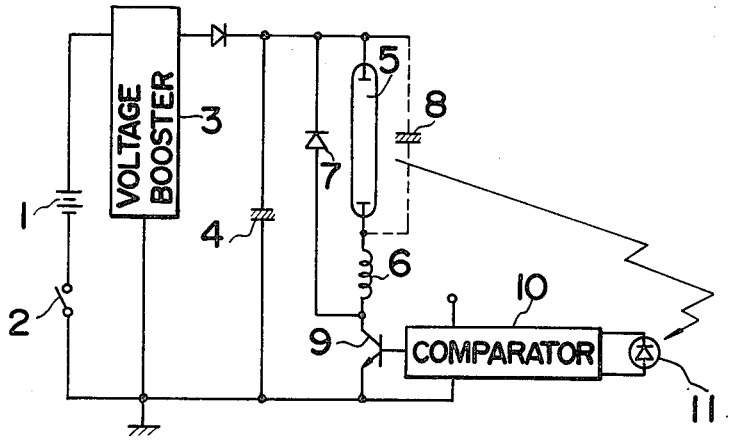
FIG. 1 is a circuit diagram showing a schematic view of an embodiment of the present invention.

With reference to FIG. 1, a flash light source represented by a series connected Xenon tube 5, inductor 6 and transistor 9 is connected across the terminals of main capacitor 4. Capacitor 8 may be connected in parallel with Xenon tube 5 as indicated by the broken line. It should be understood that capacitor 8 is provided only to lengthen the period L of variations in the emitted light intensity of Xenon tube 5 and is not necessarily provided. Diode 7 is connected across the series connected Xenon tube 5 and inductor 6 with a polarity opposite to, or counter to, the direction of current supply from main capacitor 4 to flash tube 5.

Photoelectric element 11 is adapted to directly receive the light emitted from Xenon tube 5 to generate a photoelectric current as a function of the intensity of the emitted light. Comparator control circuit 10, to which photoelectric element 11 is connected, consists mainly of a switching circuit, such as a Schmitt trigger circuit, which is adapted for use in a camera exposure control circuit and which has a hysteresis characteristic such that circuit 10 generates a control signal to turn off transistor 9 when the intensity of emitted light from Xenon tube 5 reaches, or exceeds, a first predetermined level; and turns on transistor 9 when the emitted light intensity decreases to, or below, a second predetermined level lower than the first level.

When power switch 2 is turned on, electric energy is supplied from power supply battery 1 through booster circuit 3, such as a DC to DC converter, to main capacitor 4 to charge the latter to a predetermined voltage, e.g. 300 V. Further, before the firing of flash tube 5, the output voltage of voltage comparator 10 is at a high level with transistor 9 being turned on. When Xenon tube 5 is triggered in a conventional manner by a conventional triggering means (not shown), Xenon tube 5 begins light emission, accompanied by discharge of main capacitor 4 to Xenon tube 5. As the discharge current increases, the intensity of emitted light also increases. At this time, inductor 6 functions to decelerate the increase of emitted light intensity and stores energy in the form of a magnetic field. When the intensity of emmitted light from Xenon tube 5 reaches a first predetermined level, the output voltage of voltage comparator 10 is inverted to a low level, causing transistor 9 to be turned off. Thus, the discharge of main capacitor 4 is interrupted, but, at this time, the electricity stored in capacitor 8 and energy stored in inductor6 are discharged to Xenon tube 5, whereby the intensity of emitted light decreases gradually with elapse of time without becoming abruptly zero. When the intensity of emitted light reaches a second predetermined level which is lower than the first level, transistor 9 is turned on again, causing the intensity of emitted light to increase. This operation repeats until the voltage of main capacitor 4 becomes lower than the level that guarantees the operation of Xenon tube 5. Thus, the emitted light intensity is maintained substantially constant over a predetermined period of time.

Figure 2:
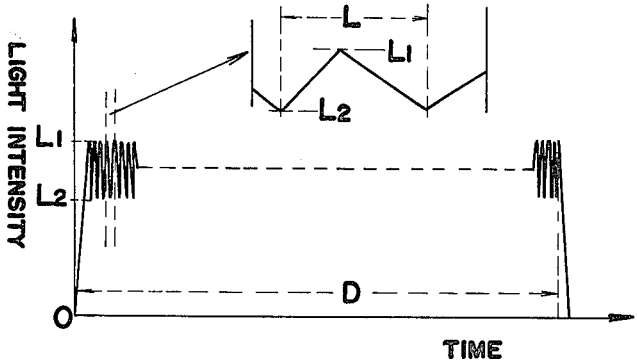
FIG. 2 is a graph illustrating the light emission properties of an electronic flash device in accordance with the present invention.

FIG. 2 shows the light emission property of Xenon tube 5 which is controlled by the circuit of FIG. 1. In a representative numerical example of circuit constants of the circuit of FIG. 1, main capacitor 4 has a capacitance of 1000 $\mu$F, and is to be changed to 300 V, the inductance of inductor 6 is 500 $\mu$H, the capacitance of capacitor 8 is 5 $\mu$F and the discharge currents of Xenon tube 5 corresponding to the first luminance level L1 and second luminance level L2 are 4.5 A and 4 A, respectively. Then the period of sawtooth waves shown in FIG. 2 is approximately 100 $\mu$sec and the duration D of light emission is approximately 20 msec.

Figure 3:
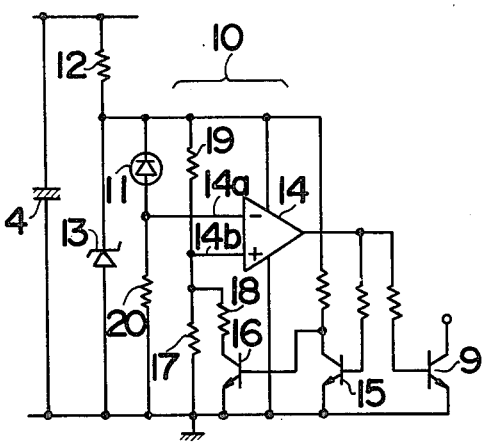
FIG. 3 is a circuit diagram of an embodiment of the control circuit to be used in the circuit of FIG. 1.

FIG. 3 shows an embodiment of control circuit 10 of FIG. 1 having the aforementioned hysteresis characteristics. With reference to FIG. 3, series connected resistor 12 and Zener diode 13 constitute a constant-voltage circuit for generating a constant-voltage across Zener diode 13. When the voltage level at input 14*a* is lower than the voltage level at input 14*b*, voltage comparator 14 generates a high level voltage, thereby turning on transistors 9 and 15. Conversely, when the voltage level at input 14*a* is higher than the voltage at input 14*b*, the output level of voltage comparator 14 is low, causing transistors 9 and 15 to be turned off. Transistor 16 turns "OFF" and "ON" in response to the "ON" and "OFF" conditions of transistor 15. The switching operation of transistor 16 causes the voltage at terminal 14*b* to change between a first level determined by the resistances of resistors 17 and 19, and a second level determined by the resistance of resistor 19 and the combined resistance of parallel connected resistors 17 and 18. Resistor 20 receives photoelectric current from photoelectric element 11, thereby generating across the terminals thereof a voltage commensurate with the intensity of the light emitted from Xenon tube 5.

When Xenon tube 5 is fired with main capacitor 4 having been charged to a predetermined voltage level, a voltage commensurate with the intensity of light emitted from the Xenon tube appears across resistor 20 and is applied to input 14*a* of voltage comparator 14. At first, the voltage level of input 14*a* is lower than that of input 14*b*, causing output 14*c* of voltage comparator 14 to be at a high level, whereby transistors 9 and 15 are turned on and transistor 16 is turned off. In this case, input 14*b* of voltage comparator 14 is at the first level of voltage given by the voltage divider composed of resistors 17 and 19. When the intensity of light emitted from Xenon tube 5 increases to cause the voltage level at input 14*a* to reach, or exceed, the first level, the output level of voltage comparator 14 is inverted to a low level, and as a result, transistors 9 and 15 are turned off and transistor 16 is turned on. Thus, the potential at input 14*b* is changed to the second level which is lower than the first level due to the combined resistance of the parallel resistors 17 and 18. At the same time, the discharge of main capacitor 4 to Xenon tube 5 is blocked by the turning off of transistor 9, causing the intensity of light emitted from the Xenon tube to gradually decrease. When the intensity of emitted light decreases to or below the second level, the output of voltage comparator 14 changes to the high level again, thereby turning on transistors 9 and 15. Thus, the power supply from main capacitor 4 to Xenon tube 5 is resumed, whereby the intensity of emitted light increases. In this manner, the above operation is repeated.

Figure 4:
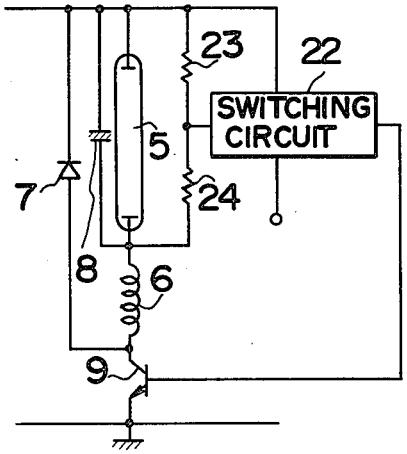

FIG. 4 shows a modification of the emitted light level detection or monitoring circuit wherein series connected resistors 23 and 24 are employed for generating a voltage commensurate with the voltage across the terminals of Xenon tube 5. Those resistors are used in place of the photoelectric means of FIG. 3, for detecting the intensity level of the light emitted from Xenon tube 5. Circuit 22 is a switching circuit having a hysteresis characteristic and is similar to the monitor circuit 10 of FIG. 3.

Figure 5:
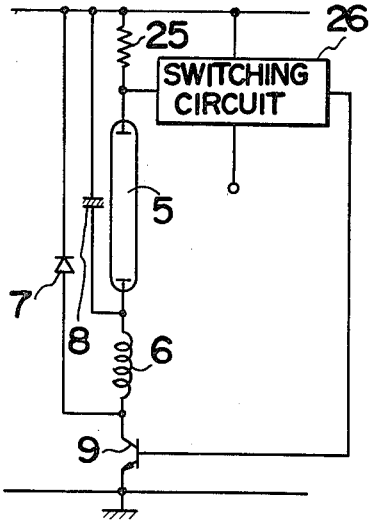
FIGS. 4 and 5 are diagrams of circuits for use in detecting a signal commensurate with the intensity of emitted light.

FIG. 5 shows a further modification of the circuit for detecting the intensity of light emitted from the Xenon tube. In the circuit, a voltage commensurate with the current flowing into Xenon tube 5 is generated across resistor 25 which is connected in series therewith. This voltage is monitored by circuit 26 to control the light emission of Xenon tube 5. Circuit 26 may have a construction identical to circuit 22 of FIG. 4.

Figure 6:
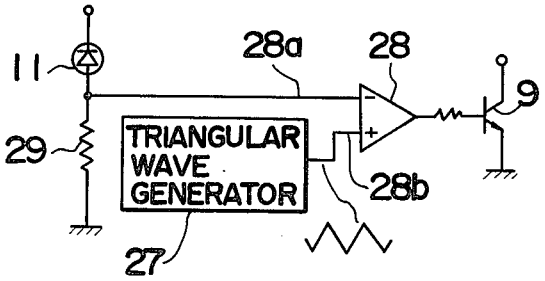
FIG. 6 shows a modification of the monitor circuit in FIG. 1.
Figure 7:
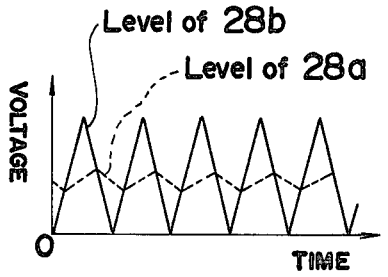
FIG. 7 is a graph illustrating the operation of the circuit in FIG. 6.

FIG. 6 shows another embodiment of control circuit 10 to be used in the present invention, wherein a voltage proportional to the intensity of light emitted from the Xenon tube is given to one input 28*a* of voltage comparator 28 by series connected photodiode 11 and resistor 29, while a triangular wave voltage of a predetermined cycle generated by triangular wave generator 27 is applied to the other input 28*b*. Representative waveforms of the signals at inputs 28*a* and 28*b* are shown in FIG. 7. With the above circuit construction, when the intensity of light emitted from the Xenon tube is high, the period during which the output voltage of voltage comparator 28 is at a high level is short, and conversely when the intensity is low, the period is long. As a result of such operation, Xenon tube 5 emits averaged light at approximately constant intensity in accordance with the cycle of the triangular wave voltage signal, over a predetermined period of time. It is apparent that photodiode 11 is arranged to receive the light from the Xenon tube.

Figure 8:
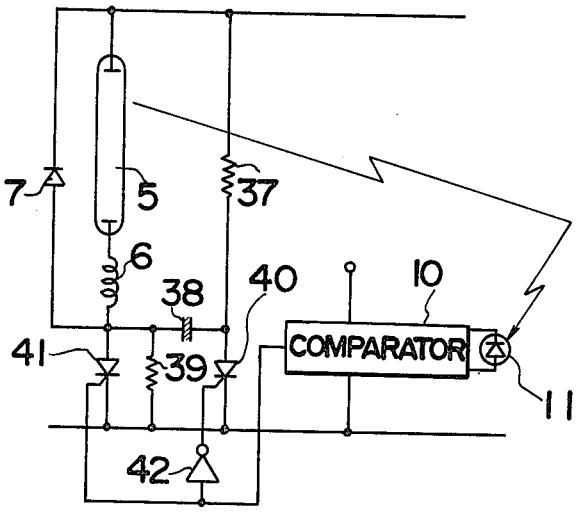
FIG. 8 shows an embodiment of circuit construction wherein transistor 9 in FIG. 1 is replaced by a thyristor.

FIG. 8 is a circuit diagram of still another embodiment, showing a control circuit employing thyristor 41 as a switching element, in place of the transistor 9 as used in the previously described embodiments. A circuit comprising resistors 37 and 39, capacitor 38 and thyristor 40 is a breaking circuit for thyristor 41. Monitor circuit 10 has the same construction as the circuit 10 of FIG. 1. When Xenon tube 5 is triggered to start light emission, the output voltage of monitor circuit 10 is at a high level and thyristor 41 is turned on, causing the intensity of emitted light to increase. When the intensity of emitted light exceeds the first predetermined luminance level, the output voltage of monitor circuit 10 becomes low, causing a high level voltage to be applied through inverter 42 to the gate of thyristor 40, which is in turn made conductive, whereby the breaking circuit of thyristor 41 is turned on to apply a reverse voltage across the anode and cathode of thyristor 41 to block the latter. This causes the intensity of emitted light to decrease, and when it decreases to the second predetermined luminance level, the output voltage of monitor circuit 10 is inverted again to a high level, thereby triggering thyristor 41 to make the latter conductive. Thus, the turn on and off of thyristor 41 is controlled, causing light emission to be maintained at a constant level over a predetermined period of time.

It is obvious to those skilled in the art that the circuit components shown in the Figures are interchangeable. For example, the junction between the resistors 23 and 24 of FIG. 4, or the junction between the resistor 25 and flash tube 5 may be connected to input terminal 14*a* of FIG. 3 or 28*a* of FIG. 6.

While the described embodiments represent the preferred forms of the present invention, it is to be understood that various modifications will occur to those skilled in the art without departing from the spirit of the invention. The scope of the invention is therefore to be determined solely by the appended claims.

What is claimed is:

1. An electronic flash device comprising:

an electronic flash tube for emitting flash light;

a main capacitor for storing electric energy for energizing said flash tube;

an inductor means;

a switching means, said inductor means and said switching means being connected in series with said flash tube across said main capacitor;

a diode connected across said series connected flash tube and said inductor means, with a polarity opposite to the direction of energy supply from said main capacitor to said flash tube;

means for monitoring the intensity of the light emitted from said flash tube; and means for controlling said switching means in accordance with the light intensity monitored by said monitor means such that said light intensity is maintained substantially constant.

2. An electronic flash device as in claim 1 wherein said monitor means includes means for generating an output as a function of said light intensity, and said control means includes means for generating a first reference level, means for generating a second reference level lower than said first reference level, and means for comparing said output with said first and said second reference levels to turn off said switching means when said output exceeds said first reference level and to turn on said switching means when said output becomes lower than said second reference level.

3. An electronic flash device as in claim 2 wherein said control means further includes means for alternatively connecting said first and said second reference level generating means to the input of said comparison means in accordance with the output of said comparison means.

4. An electronic flash device as in claim 1 further comprising a second capacitor connected across said flash tube.

5. An electronic flash device as in claim 1 wherein said monitor means includes a photoelectric member arranged to receive the light emitted from said flash tube.

6. An electronic flash device as in claim 1 wherein said monitor means includes voltage detector means for detecting the voltage across said flash tube.

7. An electronic flash device as in claim 6 wherein said voltage detector means includes a voltage divider connected across said flash tube.

8. An electronic flash tube as in claim 1 wherein said monitor means includes current detector means for detecting the current flowing through said flash tube.

9. An electronic flash device as in claim 8 wherein said current detector means includes a resistor connected in the current supply circuit for the flash tube.

10. An electronic flash device as in claim 1 wherein said monitor means includes means for generating an output as a function of the intensity of the light emitted from said flash tube, and said control circuit includes means for generating a triangular wave signal and a comparison means for controlling said switching means in accordance with the comparison of said output with said triangular wave signal.

11. An electronic flash device as in claim 1 wherein said switching means includes a transistor having a base electrode connected with said monitor means and emitter-collector electrodes connected in series with said inductor means.

12. An electronic flash device as in claim 1 wherein said switching element includes a thyristor connected in series with said inductor means and said control means includes means for turning on and off said thyristor in accordance with the light intensity monitored by said monitor means.

* * * * *